US006189345B1

(12) United States Patent
Sangiacomo

(10) Patent No.: US 6,189,345 B1
(45) Date of Patent: Feb. 20, 2001

(54) YARN-LOCKING/CUTTING DEVICE FOR CIRCULAR STOCKING KNITTING AND KNITTING MACHINES

(75) Inventor: Fulvio Sangiacomo, Brescia (IT)

(73) Assignee: Sangiacomo S.p.A., Brescia (IT)

( * ) Notice: Under 35 U.S.C. 154(b), the term of this patent shall be extended for 0 days.

(21) Appl. No.: 09/535,709

(22) Filed: Mar. 27, 2000

(30) Foreign Application Priority Data

Jun. 11, 1999 (IT) ..... BS99A0057

(51) Int. Cl.[7] ..... D04B 15/60
(52) U.S. Cl. ..... 66/134; 66/140 R
(58) Field of Search ..... 66/134, 140 R, 66/142, 145 R

(56) References Cited

U.S. PATENT DOCUMENTS

| | | | | |
|---|---|---|---|---|
| 3,598,158 | * | 8/1971 | Hall | 66/145 |
| 3,803,878 | * | 4/1974 | Lonati | 66/139 |
| 4,967,575 | * | 11/1990 | Fucik et al. | 66/139 |
| 5,070,709 | * | 12/1991 | Guell | 66/139 |
| 6,000,245 | * | 12/1999 | Plath et al. | 66/139 |

* cited by examiner

*Primary Examiner*—Danny Worrell
(74) *Attorney, Agent, or Firm*—McGlew and Tuttle, P.C.

(57) ABSTRACT

A yarn-locking/cutting device for circular stocking knitting machines. The device includes two elements (16, 18), hanging from a support (17) which is arranged in a zone contained between the yarn guides and the cutting unit. The elements are inclined in the direction of rotation of the machine. One element is controlled and has a mouth for taking and for moving the yarn.

15 Claims, 2 Drawing Sheets

YARN-LOCKING/CUTTING DEVICE FOR CIRCULAR STOCKING KNITTING AND KNITTING MACHINES

FIELD OF THE INVENTION

The present invention pertains to the field of circular stocking knitting and knitting machines and pertains, in particular, to a device for locking yarns, especially elastic yams, which are removed from time to time in the course of a cycle of manufacturing a knitted article on such machines.

BACKGROUND OF THE INVENTION

Stocking knitting and knitting machines are usually provided with a cutting unit. This unit is intended to cut the yarn or yarns when they must be removed from the knitting though maintaining them in a position to be picked up again by the needles with an appropriate movement of the yarn guides and subsequently knitted. Also associated with the cutting unit are devices for locking the adjacent yarns by pneumatic openings to hold back the yarns proper until they will be taken up again by the needles.

One problem with the prior-art yarn-locking devices is that they do not effectively hold back the yarns, especially if they are elastic yarns; therefore, they tend to easily miss even the pneumatic openings. Another problem of the prior-art yarn-locking devices is that they do not always ensure that the yarns removed from the knitting will maintain a suitable position for their certain picking up again by the needles.

SUMMARY AND OBJECTS OF THE INVENTION

The principal object of the present invention is to provide the means to effectively solve the problems mentioned above, thus ensuring the locking even of elastic yams in the position of not knitting and/or arranging these yarns with such an orientation that they may be easily picked up again by the needles.

Another object of the present invention is to provide a yarn-locking device that is adaptable and may also be used as a yam-cutting device in addition to the usual cutting unit present in circular knitting machines.

According to the invention, a yarn-locking/cutting device is provided for circular stocking knitting machines that have knitting needles, yarn guides for supplying the yarns to the needles and can be moved from a position of knitting to a position of not knitting. The invention also provides a cutting unit for taking and cutting the yarns when they are removed from the knitting. Two elements are provided, one fixed (the fixed element) and the other oscillating (the oscillating element), interacting by way of pliers or scissors, hanging from a support that is arranged stationarily in a zone contained between the yarn guides and the cutting unit. The elements are inclined in the direction of rotation of the machine.

The fixed element may comprise a fixed plate which hangs from the support and which has a back side turned towards the outside of the machine. The oscillating element may comprise a locking lever, which can be moved on an oscillation pin between an inactive position, at a distance from the outer back side of the fixed plate, and an active position adjacent to the outer back side of the fixed plate. The oscillating lever may have at least one capture means for capturing the yarn and pulling and locking same towards and against the back side of the fixed plate in response to a command to exit the knitting and cut the yarn proper.

The oscillating lever may have a mouth with a notch for capturing and pulling the yarn, with the notch being turned towards the fixed plate. The oscillating lever has an angular part which extends from the lever to the fixed plate and which forms, with a lower side and a plane for supporting and allowing the yarn to slid. The supporting plane may be just above the notch for capturing and pulling the yarn.

The oscillating lever may be maintained usually in the active position by a spring connected thereto. The oscillating lever is moved into the inactive position by a pneumatic actuator acting on the lever in opposition to the spring.

The fixed and oscillating elements preferably have a sharp side for cutting the yarn when the two elements are drawn into the active position.

The device can preferably be used for positioning the yarn in relation to the knitting members by means of a controlled movement of the sole oscillating element.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 4:
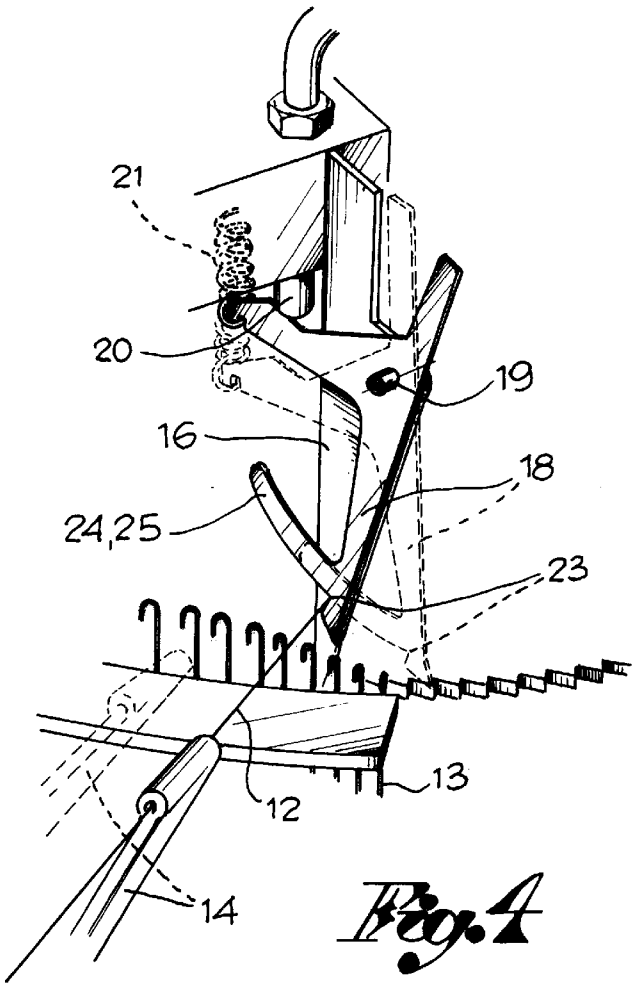
FIG. 4 is a perspective view of the device.
Figure 1:
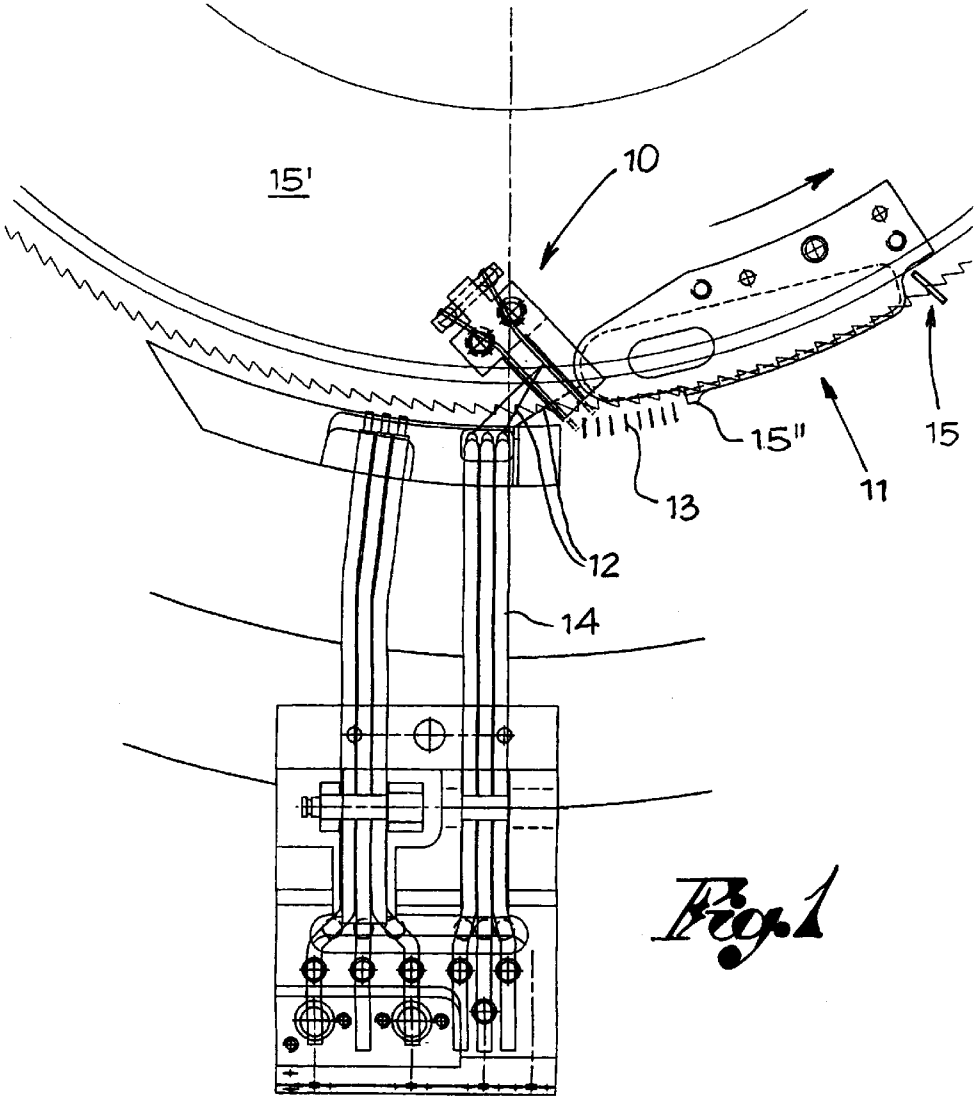
FIG. 1 is a top view of the device in relation to a part of a circular machine, of which some needles, a yarn-cutting unit and yarn guides are shown.

Referring to the drawings in particular, the device according to the present invention is indicated globally by 10. The device 10 is applied to circular stocking knitting and knitting machines 11 corresponding to each station for feeding yarns 12 to be knitted. Each machine usually comprises knitting needles 13, yarn guides 14 for supplying the yarns to the needles 13, and it can be moved between a knitting position A and a position of not knitting B (see FIGS. 2 and 3 respectively), and a cutting unit 15 for cutting the yarns when they are removed from the knitting.

The device 10 is arranged above a plate 15' lying above the needles, which plate may be that of the hooks, in a zone contained between the yarn guides 14 and an opening 15" for drawing in the yarns and oriented not radially, but inclined in the direction of rotation of the machine.

More precisely, the device 10 consists of a fixed plate hanging from a support 17 and from a locking plate or lever 18 oscillating on a pin 19 in relation to the fixed plate 16. This fixed plate 16 has a back side 16' turned towards the outside of the machine. The locking plate or lever 18 is able to be moved with scissors between an inactive position, in which it is located at a distance from the outer back side 16' of the fixed plate 16, and an active position, in which it is located adjacent to the said fixed plate. The oscillating movements of the locking lever 18 are, e.g., controlled in one direction by a pneumatic actuator 20 and in the opposite direction by a spring 21. The pneumatic actuator 20 is carried by the support 17 and engages with an arm 18' that projects from the locking lever 18. The spring 21 is connected to the support 17, on the one hand, and to the arm 18' of the lever, on the other hand. Preferably, the pneumatic actuator 20 moves the locking lever into its inactive position and the spring into its active position (FIGS. 2 and 3).

The locking lever 18 has, at the bottom, a mouth 22 with a notch 23 for taking the yarn, and just above, an angular part 24 which extends from the notch 23 to the fixed plate 16 and which, with its lower side 25, forms a plane for supporting and sliding the yarn.

Figure 2:
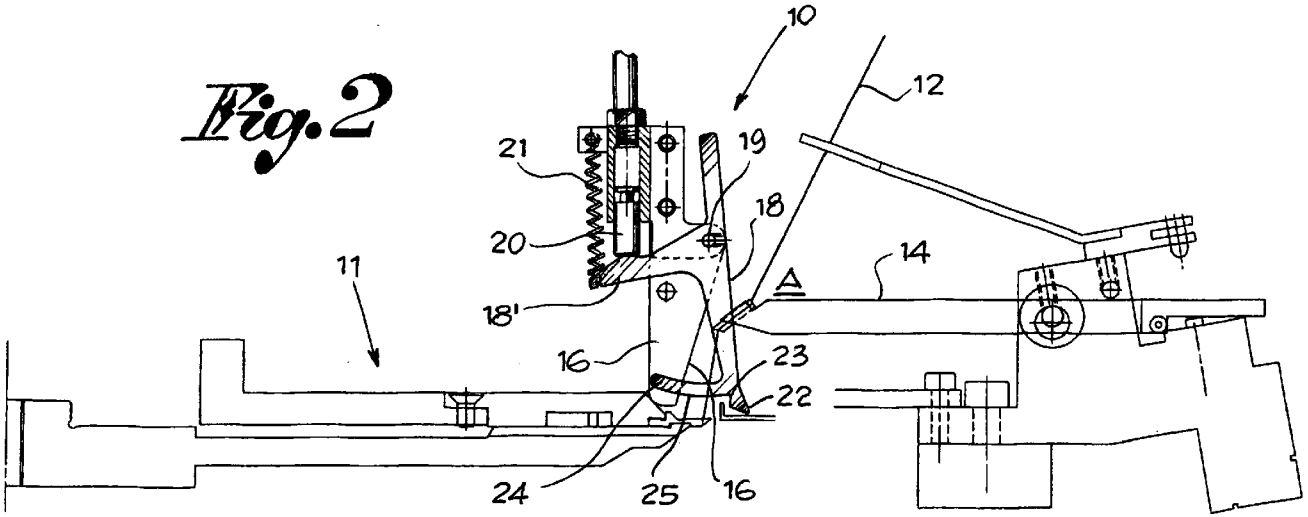
FIG. 2 is a lateral view of the device in an inactive position, i.e., not having influence on the yarn.
Figure 3:
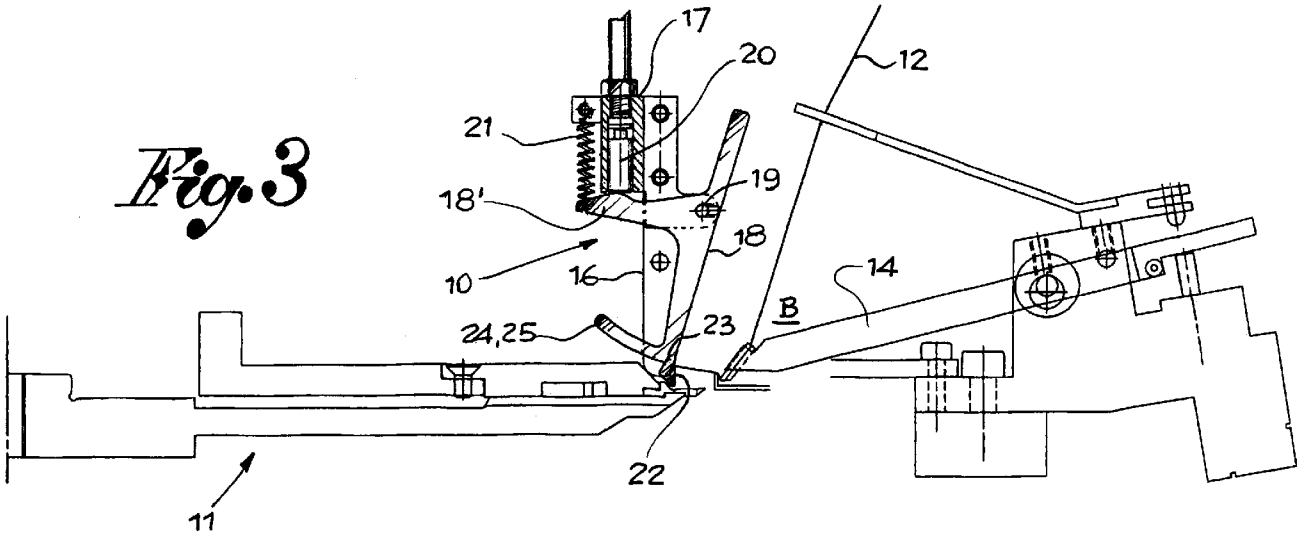
FIG. 3 is a view that is similar to FIG. 2, but with the device in an active position of locking the yarn.

When the locking lever 18 is arranged and maintained in its inactive, open position far away from the fixed plate 16, as is shown in FIG. 2, it does not have any influence on any yarn 12 that a respective yarn guide 14 puts into a knitting position A to the knitting needles. The yarn 12 is very close to the support plane 25 of the lower side of the part 24 and is directed to the needles according to an appropriate angulation (cf. also dashed lines in FIG. 4).

If a yarn must be removed from the knitting, and be cut, the respective yarn guide is brought into the position of not knitting (FIG. 3) and the locking lever 18 is brought into its active position of closing against the fixed plate 16. With its movement the locking lever captures the yarn with its lower mouth 22, at the level of the notch 23, dragging it along with it until it locks it against the side 16' of the fixed plate 16 (cf. also solid lines in FIG. 4).

The yarn is thus held back mechanically by the locking device with no possibility of slipping even if the yarn is of the elastic type. In addition, the yarn is positioned and is oriented in relation to the needles so as to be able to be easily taken up again by these when the knitting is subsequently resumed.

In addition to what has been described above, it should be noted that the locking device may also be used as an instrument for cutting yarn by simply sharpening the fixed plate and/or the intake mouth in order to make one and/or the other a cutting edge.

Finally, the oscillating lever 18, and thanks to its movements, may also be used simply as a means for a positioning without locking the yarns, in particular the inelastic yarns, in relation to the knitting members, always with the purpose of making the taking-up again of the yarns easier, when they are placed back into the knitting position after removal.

While specific embodiments of the invention have been shown and described in detail to illustrate the application of the principles of the invention, it will be understood that the invention may be embodied otherwise without departing from such principles.

What is claimed is:

1. A yarn-locking/cutting device comprising:

a circular stocking knitting machine with knitting needles, yarn guides for supplying yarns to the needles and movable from a position of knitting to a position of not knitting, and a cutting unit for taking and cutting the yarns when the yarns are removed from the knitting;

a support;

a fixed element; and an oscillating element, said fixed element and said oscillating element interacting with a pliers or scissors action and hanging from said support, said support being arranged stationarily in a zone contained between the yam guides and the cutting unit, said elements being inclined in a direction of rotation of the circular stocking knitting machine, said fixed element includes a fixed plate which hangs from said support and which has a back side turned towards an outside of the circular stocking knitting machine, and said oscillating element includes a locking lever movable on an oscillation pin between an inactive position at a distance from the outer back side of the fixed plate and an active position adjacent to the outer back side of the fixed plate, said oscillating lever having at least one means for capturing the yarn and pulling and locking same towards and against said back side of said fixed plate in response to a command to exit the knitting and cut the yarn proper.

2. A yarn-locking/cutting device in accordance with claim 1, wherein said oscillating lever has a mouth with a notch for capturing and pulling the yarn, said notch being turned towards said fixed plate.

3. A yarn-locking/cutting device in accordance with claim 1, wherein said oscillating lever has an angular part which extends from said lever to said fixed plate and which forms, with a lower side, a plane for supporting and sliding the yarn, said supporting plane being just above said notch for capturing and pulling the yarn.

4. A yarn-locking/cutting device in accordance with claim 2, wherein said oscillating lever has an angular part which extends from said lever to said fixed plate and which forms, with a lower side, a plane for supporting and sliding the yarn, said supporting plane being just above said notch for capturing and pulling the yarn.

5. A yarn-locking/cutting device in accordance with claim 1, wherein said oscillating lever is usually maintained in an active position by said spring connected thereto, and is moved into an inactive position by said pneumatic actuator acting on said lever in opposition to said spring.

6. A yarn-locking/cutting device in accordance with claim 1, wherein one of said fixed and oscillating elements has a sharp side for cutting the yarn when the said two elements are drawn into the active position.

7. A yarn-locking/cutting device in accordance with claim 1, wherein only a single said oscillating element is provided, which is controlled for positioning the yarn in relation to the knitting members.

8. A circular stocking knitting machine in combination with a yarn-locking/cutting device, the combination comprising:

a circular stocking knitting machine with knitting needles, yarn guides for supplying yarn to the needles, the yarn guides being movable from a position of knitting to a position of not knitting, and a cutting unit for taking and cutting the yarn when the yarn is removed from the knitting operation;

a yarn-locking/cutting device with a support, a fixed element and an oscillating element, said fixed element and said oscillating element pivoting, one relative to the other and each supported by said support, said support being arranged stationarily in a zone contained between the yarn guides and the cutting unit, said elements being at an angle relative to a radial direction of said circular stocking knitting machine.

9. A yarn-locking/cutting device in accordance with claim 8, wherein said fixed element includes a fixed plate which hangs from said support and which has a back side turned towards an outside of the circular stocking knitting machine, and said oscillating element includes a locking lever movable on an oscillation pin between an inactive position at a distance from the outer back side of the fixed plate and an active position adjacent to the outer back side of the fixed plate, said oscillating lever having at least one means for capturing the yarn and pulling and locking same towards and against said back side of said fixed plate in response to a command to exit the knitting and cut the yarn proper.

10. A yarn-locking/cutting device in accordance with claim 9, wherein said oscillating lever has a mouth with a notch for capturing and pulling the yarn, said notch being turned towards said fixed plate.

11. A yarn-locking/cutting device in accordance with claim 9, wherein said oscillating lever has an angular part which extends from said lever to said fixed plate and which forms, with a lower side, a plane for supporting and sliding the yarn, said supporting plane being just above said notch for capturing and pulling the yarn.

12. A yarn-locking/cutting device in accordance with claim 10, wherein said oscillating lever has an angular part which extends from said lever to said fixed plate and which forms, with a lower side, a plane for supporting and sliding the yam, said supporting plane being just above said notch for capturing and pulling the yarn.

13. A yarn-locking/cutting device in accordance with claim 9, wherein said oscillating lever is usually maintained in an active position by said spring connected thereto, and is moved into an inactive position by said pneumatic actuator acting on said lever in opposition to said spring.

14. A yarn-locking/cutting device in accordance with claim 8, wherein one of said fixed and oscillating elements has a sharp side for cutting the yarn when the said two elements are drawn into the active position.

15. A yarn-locking/cutting device in accordance with claim 8, wherein only a single said oscillating element is provided, which is controlled for positioning the yarn in relation to the knitting members.

* * * * *